US012173414B2

(12) United States Patent
Chamoun

(10) Patent No.: US 12,173,414 B2
(45) Date of Patent: Dec. 24, 2024

(54) CATHODIC PROTECTION SYSTEM AND METHOD

(71) Applicant: Palo Alto Research Center Incorporated, Palo Alto, CA (US)

(72) Inventor: Jacob Chamoun, Somerville, MA (US)

(73) Assignee: Xerox Corporation, Norwalk, CT (US)

( * ) Notice: Subject to any disclaimer, the term of this patent is extended or adjusted under 35 U.S.C. 154(b) by 468 days.

(21) Appl. No.: 17/552,805

(22) Filed: Dec. 16, 2021

(65) Prior Publication Data

US 2023/0193480 A1 Jun. 22, 2023

(51) Int. Cl.

| | |
|---|---|
| ***C23F 13/04*** | (2006.01) |
| ***C23F 13/20*** | (2006.01) |
| ***C23F 13/22*** | (2006.01) |

(52) U.S. Cl.

CPC ..... *C23F 13/04* (2013.01); *C23F 13/20* (2013.01); *C23F 13/22* (2013.01); *C23F 2213/10* (2013.01); *C23F 2213/20* (2013.01)

(58) Field of Classification Search

CPC ..... C23F 13/04; C23F 13/20; C23F 13/22; C23F 2213/10; C23F 2213/20; G01N 17/02; G01N 17/0008; G01N 17/04

See application file for complete search history.

(56) References Cited

U.S. PATENT DOCUMENTS

| | | | |
|---|---|---|---|
| 3,953,742 A | 4/1976 | Anderson et al. | |
| 5,102,514 A | 4/1992 | McCready | |
| 7,238,263 B2 | 7/2007 | Howard, Jr. et al. | |
| 10,119,726 B2 | 11/2018 | Smith et al. | |
| 2006/0006555 A1 | 1/2006 | Herman | |
| 2006/0054072 A1 | 3/2006 | Sica et al. | |
| 2006/0213765 A1 | 9/2006 | Mizuno et al. | |
| 2008/0150555 A1* | 6/2008 | Wang | G01M 11/085 324/693 |
| 2017/0191171 A1 | 7/2017 | Aljabri | |
| 2018/0083715 A1 | 3/2018 | Greene et al. | |
| 2019/0010614 A1* | 1/2019 | Whitmore | C23F 13/04 |

FOREIGN PATENT DOCUMENTS

| | | |
|---|---|---|
| CN | 207 567 349 U | 7/2018 |
| KR | 1020170030849 | 3/2017 |

OTHER PUBLICATIONS

Borin Manufacturing, Inc., "DART Remote Monitoring for Test Points", Aug. 19, 2016, 2 pages.

Deepwater Corrosion Services, Inc., "Deepwater—Cathodic Protection Monitoring MA-1 Monitored Anode", 1 page.

(Continued)

*Primary Examiner* — Alexander S Noguerola

(74) *Attorney, Agent, or Firm* — Mueting Raasch Group

(57) ABSTRACT

A system comprises a cathodic protection system having an anode and configured to protect a protected structure from corrosion. The system comprises a monitoring circuit operatively coupled to the cathodic protection system. The monitoring circuit comprises an electrical-to-optical transducer. The electrical-to-optical transducer is configured to generate a light signal in response to electrical current flowing between the protected structure and the anode of the cathodic protection system, the protected structure and a reference electrode, or the reference electrode and the anode.

25 Claims, 8 Drawing Sheets

(56) References Cited

OTHER PUBLICATIONS

Figueira, "Electrochemical Sensors for Monitoring the Corrosion Conditions of Reinforced Concrete Structures: A Review", Applied Sciences, No. 7, Nov. 10, 2017, 29 pages.
Kim et al., "Energy Harvesting from Anti-Corrosion Power Sources", Aug. 11, 2014, 6 pages.
Liang, "In-Line Fiber Optic Sensing System for Pipeline Corrosion Detection", Mar. 2015, 67 pages.
Koch et al., "International Measures of Prevention, Application, and Economics of Corrosion Technologies Study", 2016, 216 pages.
Silva et al., "Optical Current Sensors for High Power Systems: A Review", Appl. Sci, Feb. 2012, pp. 602-628.
U.S. Department of the Interior, "Corrosion and Cathodic Protection", Sep. 2013, 98 pages.
European Patent Application No. 22209831.1; Extended European Search Report issued Jul. 7, 2023.

* cited by examiner

CATHODIC PROTECTION SYSTEM AND METHOD

TECHNICAL FIELD

The present disclosure is directed to cathodic protection systems and methods.

BACKGROUND

Metal structures spontaneously oxidize in the presence of oxygen and common electrolytes such as water or soil. Oxidation turns metals into their oxide form (e.g., rust), which disintegrates and can cause structures to fail. This process, called corrosion, affects bridges, tanks, pipelines, sea walls, and other civil structures. The cost of corrosion was estimated at 2.7% of US GDP, or $450B in 2013. Cathodic protection (CP) systems prevent corrosion by providing an input of energy in the form of electric current from a more electrically active metal (sacrificial anode) or DC power supply (impressed current). It can be difficult to monitor how well a CP system is working because the structure/anodes are buried in soil, underwater, or encased in concrete, making them difficult to inspect.

BRIEF SUMMARY

Some embodiments are directed to a system comprising a cathodic protection system having an anode and configured to protect a protected structure from corrosion. The system comprises a monitoring circuit operatively coupled to the cathodic protection system. The monitoring circuit comprises an electrical-to-optical transducer. The electrical-to-optical transducer is configured to generate a light signal in response to electrical current flowing between the protected structure and the anode of the cathodic protection system, the protected structure and a reference electrode, or the reference electrode and the anode.

Some embodiments are directed to a method comprising protecting a protected structure from corrosion using a cathodic protection system comprising an anode. The method comprises monitoring for corrosion at the protected structure using a monitoring circuit comprising an electrical-to-optical transducer. The method also comprises generating, by the electrical-to-optical transducer, a light signal in response to electrical current flowing between the protected structure and the anode, the protected structure and a reference electrode, or the reference electrode and the anode. The method further comprises communicating the light signal to a remote data acquisition system via a fiber-optic link.

The above summary is not intended to describe each disclosed embodiment or every implementation of the present disclosure. The figures and the detailed description below more particularly exemplify illustrative embodiments.

BRIEF DESCRIPTION OF DRAWINGS

The figures are not necessarily to scale. Like numbers used in the figures refer to like components. However, it will be understood that the use of a number to refer to a component in a given figure is not intended to limit the component in another figure labeled with the same number.

DETAILED DESCRIPTION OF ILLUSTRATIVE EMBODIMENTS

Figure 1:
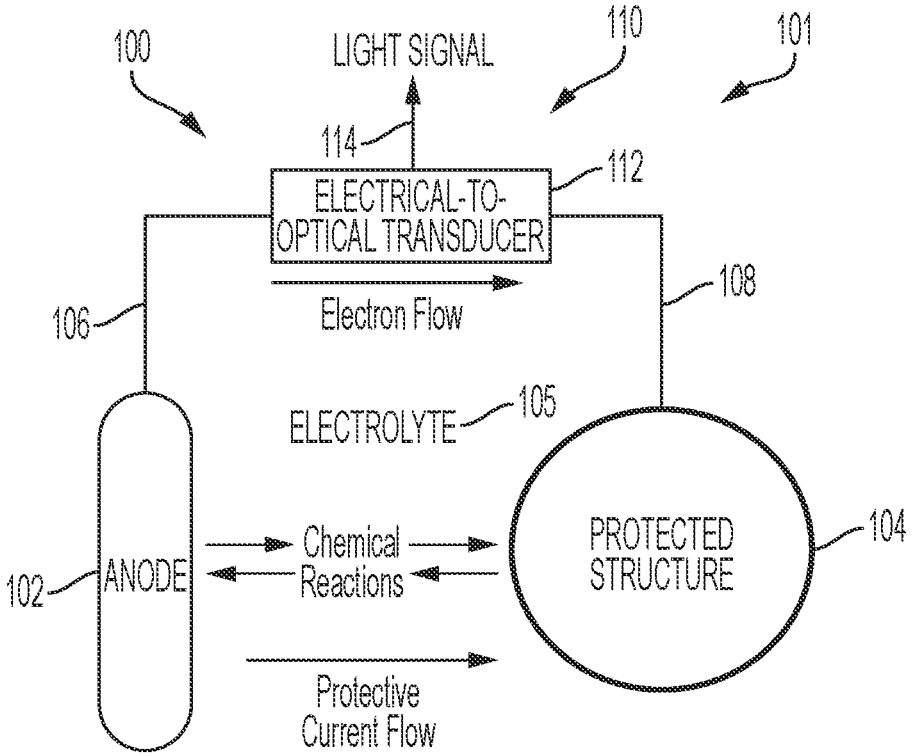
FIG. 1 illustrates a system which includes a CP system configured to protect a protected structure from corrosion in accordance with various embodiments, the CP system comprising an electrical-to-optical transducer.

A wide array of electrochemical sensors exist for monitoring corrosion based on open circuit potential, surface potential, concrete resistivity, polarization resistance, noise analysis, and galvanic current. These approaches are hampered by issues with durability, sensitivity to electromagnetic interference (EMI), and stability over the very long (>25 year) timescales associated with the lifetime of a civil structure.

Embodiments of the disclosure are directed to systems and methods for monitoring the status of a CP system. Embodiments of the disclosure differ from conventional electrochemical sensors in that a corrosion signal detected by the CP circuitry is converted to a light signal which is transmitted by an optical fiber, a detection and transmission method which is stable over long timescales in harsh environments and immune to EMI. For example, commercial off the shelf (COTS) telecom-grade laser diodes have a lifetime of 10^6 hours (>100 years).

Fiber optic sensors based on a fiber Bragg grating (FBG) have been demonstrated for corrosion sensing as they are rugged, immune to EMI, and can be easily multiplexed in arrays. However, FBGs are sensitive to strain and temperature only, which makes them difficult to couple to corrosion-related processes. Embodiments of the disclosure differ from FBG-based fiber sensors in that an FBG is a passive element: for an FBG sensor, an optical pulse is injected from the outside, and certain spectral components are reflected back. According to various embodiments, there is no FBG and the optical signal can be generated directly using at least some of the current from the CP system. In some implementations, an optical pulse may be injected from the outside to provide power (e.g., Power-Over-Fiber or POF) and/or trigger the start of a measurement. It is noted that fiber optic current sensors based on the Faraday effect are not sensitive enough to measure the small currents associated with corrosion.

Sacrificial anodes with built in current monitors are commercially available and can form part of a remote-monitoring cathodic protection (RMCP) system. These conventional systems communicate with a base station via a wired connection or a wireless connection. Such systems are powered via solar power, wind power, or electrical power from a rectifier (for impressed current). In some cases, RMCP nodes are equipped with a GSM or satellite transmitter to wirelessly transmit information about the state of the node.

Embodiments of the disclosure differ from these systems in that the corrosion signal is transduced to an optical signal and transmitted over optical fiber. Compared to commercial RCMP systems, fiber optic transmission provides a way to transmit signals with low loss over long distances (10-100 km) which is compatible with buried/submerged structures such as pipelines, tanks, bridge piers, and sea walls. Wireless GSM or satellite signals cannot propagate long distances underground or underwater due to absorption. The fiber connection also provides for the delivery of power to the sensor (e.g., via a POF arrangement), for transmission of a trigger signal, and to multiplex with existing fiber infrastructure, including other sensors.

Embodiments of the disclosure are directed to systems and methods for measuring the current flowing in a cathodic protection system using an optical transducer powered at least in part by the CP system. A cathodic protection system slows or halts corrosion by making the protected structure (e.g., steel) the cathode in an electrochemical circuit, such that electrons flow from an anode to the steel. This requires an input of energy. The energy is supplied by either spontaneous electron flow from a more active "sacrificial" anode (see FIG. 1) or electron flow from an inert anode powered by a DC supply "impressed current" (see FIG. 3). The circuit is completed by an electrolyte such as water, soil, or concrete between the cathode and the anode.

A unique aspect of the present disclosure is placement of a light source (e.g., a laser diode or LED) in series with the CP circuitry shown in the figures which generates light when current flows. The light signal produced by the light source can by communicated to a remote data acquisition system/analyzer via a fiber-optic link. One or more characteristics of the light signal can be analyzed to determine the presence, absence, and extent of corrosion at that protected structure (e.g., steel structure).

FIG. 1 illustrates a system 100 in accordance with various embodiments. The system 100 includes a CP system 101 comprising an anode 102 configured to protect a protected structure 104 from corrosion. The anode 102 and the protected structure 104 are disposed in, or surrounded by an environment containing an electrolyte 105, such as water (e.g., salt water), soil or concrete, and an oxidizer such as air. The protected structure 104 can take many forms, such as any structure or component made from steel or other metal which is subject to corrosion (see, e.g., examples disclosed herein). In the embodiment shown in FIG. 1, the anode 102 is a sacrificial anode made of a suitable material, such as Zn, Al, Mg or an alloy of these metals. The sacrificial material of the anode 102 corrodes instead of the metal of the protected structure 104.

Figure 2:
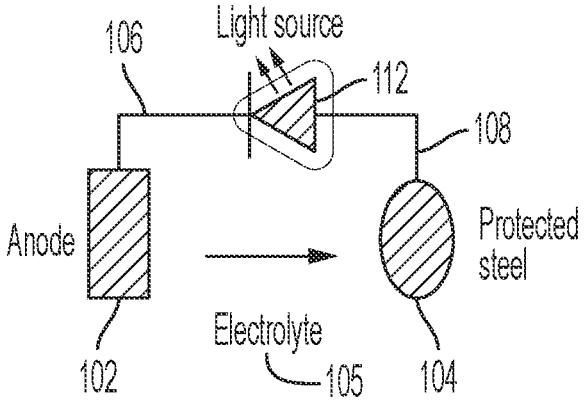
FIG. 2 illustrates a representative electrical-to-optical transducer of a CP system configured to protect a protected structure from corrosion in accordance with various embodiments.

The system 100 also includes a monitoring circuit 110 operatively coupled to the CP system 101. The monitoring circuit 110 includes an electrical-to-optical transducer 112. By way of example, and with reference to FIG. 2, the electrical-to-optical transducer 112 can include an LED, a laser diode or a superluminescent device, for example. As is shown in FIGS. 1 and 2 (and other figures), the electrical-to-optical transducer 112 is in series with the anode 102 and the protected structure 104 via electrical connections 106, 108.

The electrical-to-optical transducer 112 is configured to generate a light signal 114 in response to electrical current flowing between the protected structure 104 and the sacrificial anode 102 of the CP system 101. As will be described hereinbelow, the light signal 114 is communicated to a data acquisition system/analyzer via a fiber-optic link. The data acquisition system/analyzer is typically situated at a monitoring station remote from the system 100.

As is best shown in FIG. 1, and during operation of the system 100, chemical reactions between the anode 102 and the surrounding environment cause a protective current to flow between the sacrificial anode 102 and the protected structure 104, such that the protected structure 104 serves as a cathode. More particularly, oxidation in the electrochemical cell arrangement shown in FIG. 1 is concentrated on the sacrificial anode 102 (electron donor) liberating electrons that flow to the protected structure 104, which becomes the cathode (electron receiver) in the electrochemical circuit. An accumulation of electrons in the protected structure 104 lowers its electrochemical potential so that corrosion is slowed or halted on the protected structure 104. The sacrificial anode 102 can have varying shapes and sizes, such as wires, rods, tubes, plates, and sticks, for example.

For sacrificial anode CP systems, such as that shown in FIG. 1, the driving voltage is set by the galvanic series shown in Table 1 below, providing 0.25-1.55 V.

TABLE 1

Galvanic series of selected common metals end alloys used in sacrificial anode CP systems

| Metal | Potential vs Cu:CusO4 (V) |
|---|---|
| Mild steel in concrete | −0.2 |
| Mild steel (rusted) | −0.2-0.5 |
| Mild steel (clean) | −0.5-0.8 |
| Aluminum alloy | −1.05 |
| Zinc | −11 |
| Magnesium alloy | −1.6-1.75 |

Figure 3:
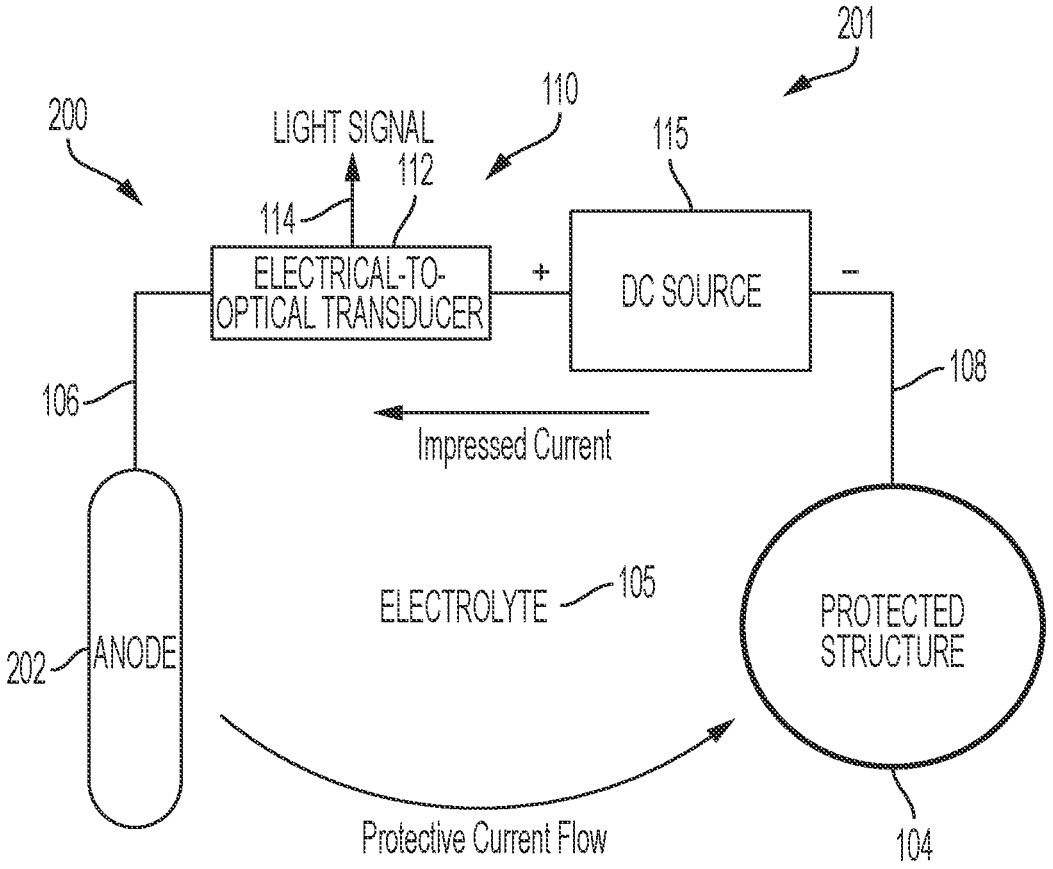
FIG. 3 illustrates a system which includes a CP system configured to protect a protected structure from corrosion in accordance with various embodiments, the CP system comprising an electrical-to-optical transducer.

FIG. 3 illustrates a system 200 in accordance with various embodiments. The system 200 includes an impressed current CP system (ICCP system) 201 comprising an inert anode 202 configured to protect a protected structure 104 from corrosion. As previously discussed, the inert anode 202 and the protected structure 104 are disposed in, or surrounded by, an electrolyte 105. In the embodiment shown in FIG. 3, the inert anode 202 can be made of graphite, cast iron, titanium alloys, silicon iron or platinum-niobium clad metals. The inert anode 202 can have varying shapes and sizes, such as wires, rods, tubes, plates, and sticks, for example.

The ICCP system 201 includes a DC power source 115 electrically connected to the inert anode 202 and the protected device 104. The inert anode 202 is driven by the DC current provided by the DC power source 115. The DC power source 115, which can be referred to as a rectifier, is configured to develop a high potential difference between the surface of the protected structure 104 to be protected and the inert anode 202. The DC power source 115 is used to generate the electric current and this current provides cathodic protection to the protected structure 104. It is noted that impressed current systems provide better results relative to sacrificial CP systems when a large current is required for cathodic protection.

For impressed current, the voltage is set by the DC power source 115 and can be 24 V or more. The current flowing in the circuit is determined by the resistivity of the electrolyte 105. The NACE specification for a structure to be considered protected is a potential of −850 mV vs copper sulfate electrode. If the potential is too negative (e.g., <−1 V vs Ag/AgCl), then the protected structure is overprotected, which degrades coatings and can weaken the structure through hydrogen embrittlement. The typical impressed current required to protect a steel structure is around 22 $mA/m^2$.

The system 200 also includes a monitoring circuit 110 operatively coupled to the CP system 201. The monitoring circuit 110 includes an electrical-to-optical transducer 112 coupled in series with the DC power source 115, the anode 202, and the protected structure 104 via electrical connections 106, 108. The electrical-to-optical transducer 112 can include an LED, a laser diode or a superluminescent device, for example. As previously discussed, the electrical-to-optical transducer 112 is configured to generate a light signal 114 in response to electrical current flowing between the protected structure 104 and the sacrificial anode 202 of the CP system 201. The light signal 114 is communicated to a data acquisition system/analyzer via a fiber-optic link. The data acquisition system is typically situated at a monitoring station remote from the system 200.

Figure 4:
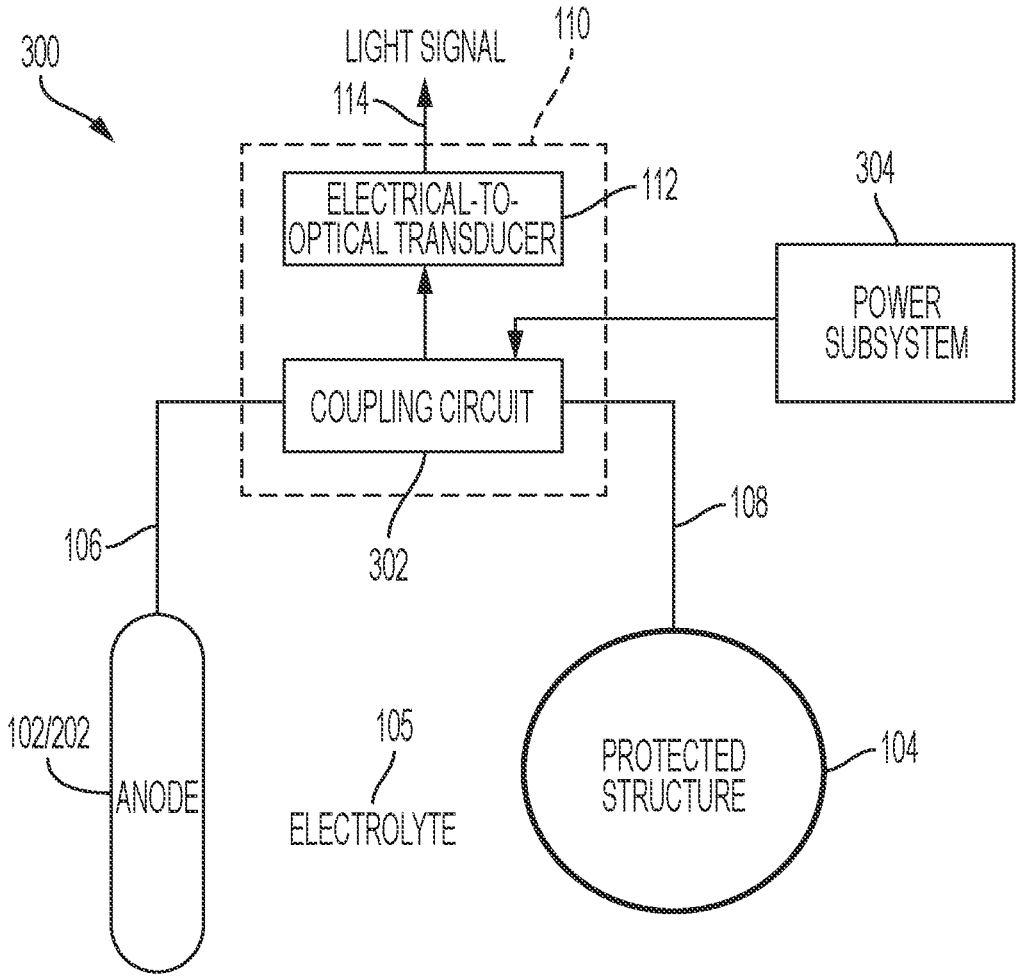
FIG. 4 illustrates a system which includes a CP system configured to protect a protected structure from corrosion in accordance with various embodiments, the CP system comprising an electrical-to-optical transducer.
Figure 5:
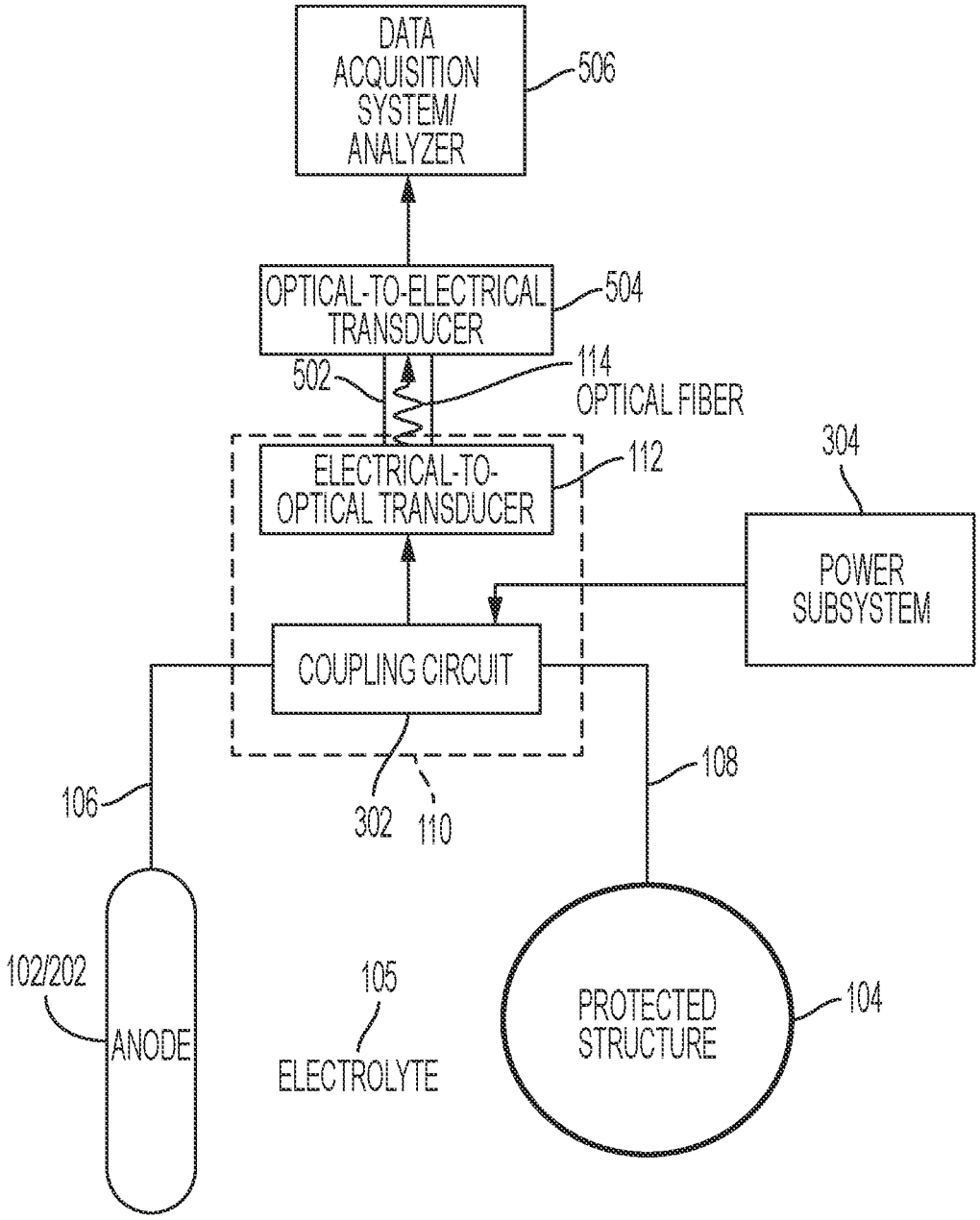
FIG. 5 illustrates a system which includes a CP system configured to protect a protected structure from corrosion in accordance with various embodiments, the CP system comprising an electrical-to-optical transducer configured to communicate a light signal to a remote data acquisition system/analyzer.

FIGS. 4 and 5 illustrate a system 300 in accordance with various embodiments. In some implementations, the system 300 can be configured as a sacrificial CP system, such that the anode 102 is a sacrificial anode as previously discussed. In other implementations, the system 300 can be configured as an impressed current CP system, such that the anode 202 is an inert anode as previously discussed. The system 300 includes a monitoring circuit 110 which includes an electrical-to-optical transducer 112 and a coupling circuit 302.

As illustrated, the coupling circuit 302 is electrically coupled to the anode 102/202 and the protected structure 104 via electrical connections 106, 108. The coupling circuit 302 is also electrically coupled to the electrical-to-optical transducer 112. The coupling circuit 302 can include a voltage converter configured to step up a voltage generated in response to the electrical current flowing between the protected structure 104 and the anode 102/202. The voltage converter of the coupling circuit 302 can be configured to drive the electrical-to-optical transducer 112 with the stepped-up voltage.

According to some embodiments, the system 300 can include a power subsystem 304. The power subsystem 304 can be configured to supply power to the monitoring system 110. For example, the power subsystem 304 can include an energy harvesting device. According to various embodiments, the energy harvesting device can include one or more of a photovoltaic cell circuit, a thermoelectric circuit, a piezoelectric circuit, and a hysteretic circuit configured to harvest energy from galvanic corrosion. The power subsystem 304 can include an energy storage device coupled to receive and store energy from the energy harvesting device. The energy storage device can include one or both of a battery and a capacitor (e.g., a supercapacitor).

The energy harvesting device circuit can combine an energy storage element, such as a capacitor, with a DC-DC converter to step up the low voltage signal from the energy harvesting device. The stored energy can be used to generate short bursts of power to acquire and transmit data in the form of a light signal 114. Off-the-shelf energy harvesting/power management ICs can run on an input voltage as low as 0.020 V and produce an output voltage of 3.3 V or more (with a correspondingly reduced average current).

As is further shown in FIG. 5, the system 300 includes an optical fiber 502 which is optically coupled to the light source of the electrical-to-optical transducer 112. The optical fiber 502 is configured to communicate the light signal 114 produced by the electrical-to-optical transducer 112 to a data acquisition system/analyzer 506. The optical fiber 502 can be a single mode optical fiber or a multi-mode optical fiber. As was previously discussed, the optical fiber 502 can communicate the light signal 114 over a substantial distance to the remote data acquisition system/analyzer 506 (e.g., up to about 100 km without amplification). The data acquisition system/analyzer 506 can be coupled to, or incorporate, and optical-to-electrical transducer 504 configured to convert the light signal 114 to a corresponding electrical signal.

In some embodiments, the power subsystem 304 can include a Power-Over-Fiber apparatus configured to convert optical energy carried by the 502 optical fiber into electrical energy. The electrical energy converted from optical energy is used to provide power to the monitoring circuit 110. As was previously discussed, the light signal 114 generated by the electrical-to-optical transducer 112 is communicated to a remote data acquisition system via the fiber-optic link 502. This same fiber-optic link 502 can be used as the optical link of the Power-Over-Fiber apparatus.

The semiconductor light source of the electrical-to-optical transducer 112 converts electrical current into light. A suitable semiconductor light source is a commodity telecom laser diode which operates at 1550 nm with a forward voltage of 1 V, a threshold current of 10 mA, and an electro/optical conversion efficiency of around 3%. Low threshold 850 nm VCSELs in research have thresholds of <1 mA at drive voltages of <2 V. This driving voltage and current is broadly compatible with the power supplied by a cathodic protection system (~1 V, 10 s of mA). The power consumption of a laser diode is around 20 mW (e.g., compare this to a wireless GSM transmitter which requires >1000 mW in a remote area).

According to some embodiments, a CP system of the present disclosure can provide sufficient power to run a laser diode as the electrical-to-optical transducer 112. Some embodiments of the disclosure aim to harvest some of the electrical energy from a CP system to drive a light source to sense the status of the CP system. For example, the light emission may provide a readout of the current flowing from anode to cathode. This provides both a qualitative verification that the circuit is complete and also a quantitative measure of how corrosive the environment is (e.g., more corrosion leads to more current which leads to more light emission).

Figure 6:
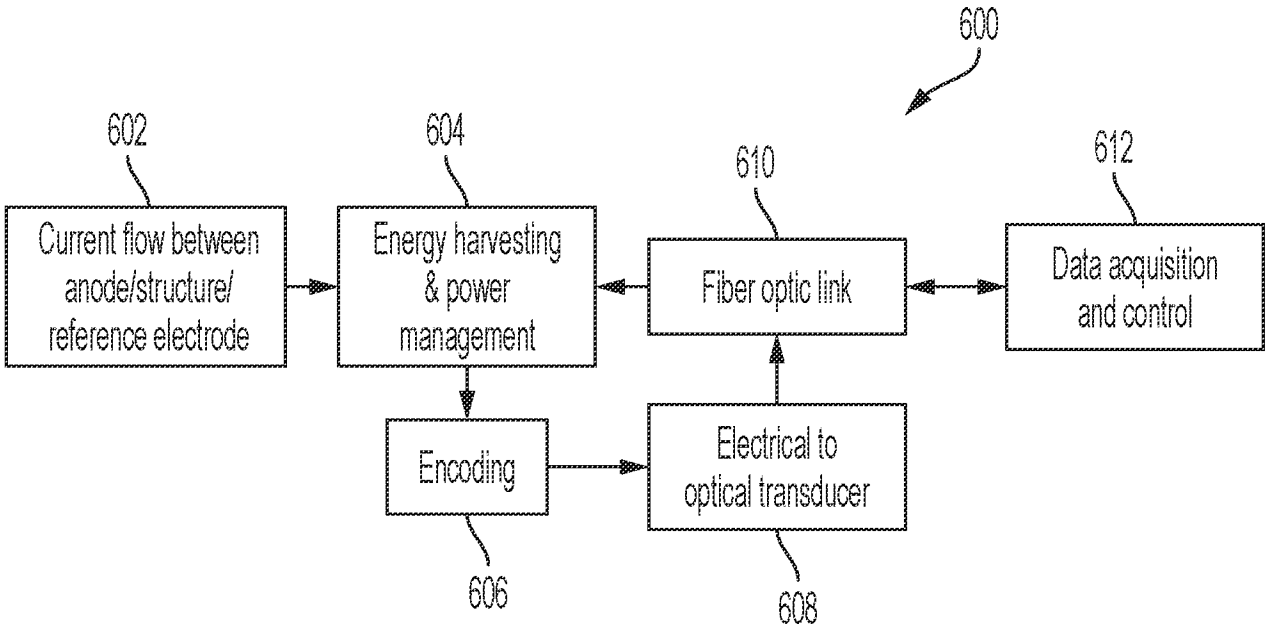
FIG. 6 is a process flow diagram involving a CP system in accordance with various embodiments.

FIG. 6 is a process flow diagram involving a CP system of the present disclosure in accordance with various embodiments. The process flow 600 shown in FIG. 6 involves current flow 602 between the anode, the protected structure, and, if present, a reference electrode. In the most general case, the coupling circuit could be between any pair of anode/structure, anode/reference electrode, or structure/reference electrode. For example, and with reference to a modified version of FIG. 5, assume that anode 102/202 is labeled placeholder electrode 1 and the protected structure 104 is labeled placeholder electrode 2. In this illustrative example, the value of each placeholder is one of the anode, structure and reference electrode. In this illustrative example, the electrical-to-optical transducer is configured to generate a light signal in response to electrical current flowing between the protected structure and the anode of the cathodic protection system, the protected structure and a reference electrode, or the reference electrode and the anode.

The process flow 600 also involves energy harvesting and power management 602, typically implemented by coupling circuitry of the CP system. The process flow 600 further involves encoding 606 an electrical signal indicative of current flow between the anode and the protected structure. The encoded electrical signal is communicated to an electrical-to-optical transducer 608 which converts the encoded electrical signal to a corresponding light signal. The light signal is transmitted to a data acquisition and control facility 612 via a fiber-optic link 610.

The data acquisition and control facility 612, which typically includes an analyzer (see, e.g., block 506 of FIG. 5), is configured to analyze the light signal to determine the presence, absence, and extent of corrosion occurring at the protected structure. The data and control facility 612 can also communicate control signals to the energy harvesting a power management facility 604 via the fiber-optic link 610. In such configurations, the energy harvesting and power management facility 604 includes an optical-to-electrical transducer. In some embodiments, optical energy can be transmitted over the fiber-optic link 610 to provide power to the energy harvesting and power management facility 604 via a Power-Over-Fiber arrangement.

Figure 7:
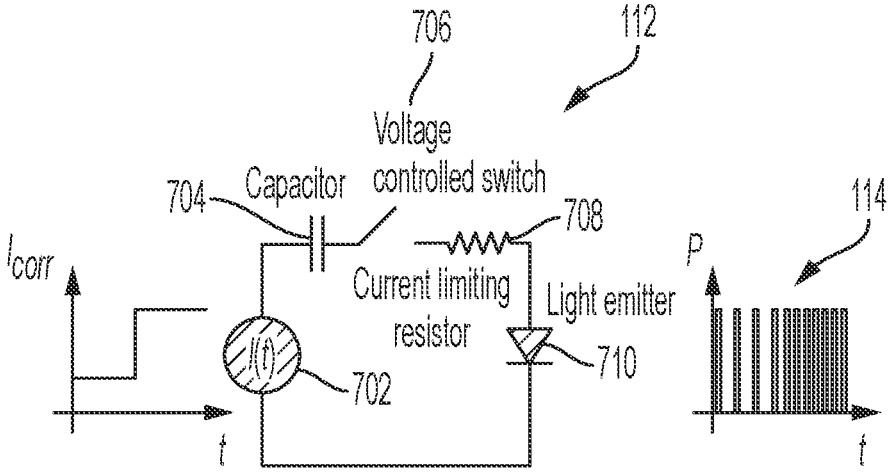
FIG. 7 illustrates circuitry of an electrical-to-optical transducer in accordance with various embodiments.

FIG. 7 illustrates circuitry of an electrical-to-optical transducer in accordance with various embodiments. The electrical-to-optical transducer 112 includes a current source 702 which is proportional to a current, $I_{corr}$, flowing between the anode and the protected structure of the CP system. The electrical-to-optical transducer 112 includes a capacitor 704 in series with a voltage controlled switch 706, a current limiting resistor 708, and a light emitter 710. The current, $I_{corr}$, charges the capacitor 704 at a charging rate proportional to the corrosion current, $I_{corr}$. Once the capacitor 704 charges to a level $V_{switch}$, the switch 706 closes and the capacitor 704 discharges a charge ($Q=V_{switch}*C$) through the current limiting resistor 708, causing the light emitter 710 to generate a light pulse. The circuitry of the electrical-to-optical transducer 112 can be implemented to encode the light signal generated by the light emitter 710 in accordance with various formats, examples of which are described below.

In some implementations, the voltage controlled switch 706 can be closed by coupling the voltage controlled switch 706 to a photovoltaic cell. In some implementations, a light pulse (e.g., a trigger stimulus) can be sent into the electrical-to-optical transducer 112 via a fiber-optic link which closes the voltage controlled switch 706 and discharges the capacitor 704. As such, data is read out of the electrical-to-optical transducer 112 only when triggered. Accordingly, the power consumption of the overall CP system is extremely low.

FIG. 8 illustrates different encoding schemes for encoding a light signal generated by the electrical-to-optical transducer 112 in accordance with various embodiments. FIG. 8 illustrates four different encoding schemes which produce different forms of an encoded light signal based on detection of a current, $I_{corr}$, flowing between the anode and the protected structure of the CP system as previously discussed (See FIGS. 7 and 8A). FIG. 8B illustrates direct analog encoding such as amplitude modulation (AM). In this encoding scheme, the light signal shown in FIG. 8B is directly proportional to the corrosion current, $I_{corr}$.

Figure 8A:
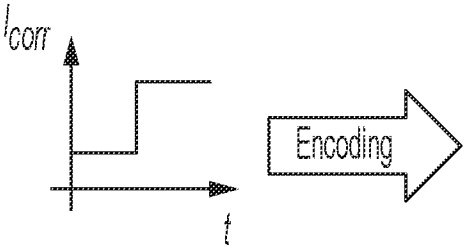
FIGS. 8A-8E illustrate different encoding schemes for encoding a light signal generated by the electrical-to-optical transducer in accordance with various embodiments.
Figure 8B:
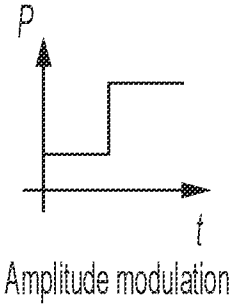
Figure 8C:
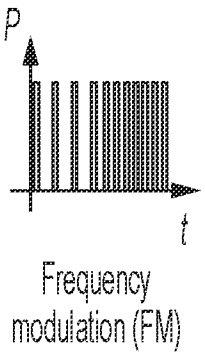
Figure 8D:
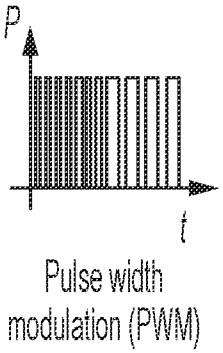
Figure 8E:
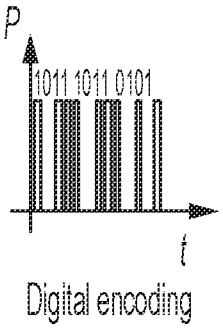

FIG. 8C illustrates frequency modulation (FM) encoding, in which the light signal shown in FIG. 8C consists of a series of pulses, and the pulse repetition rate is proportional to the corrosion current, $I_{corr}$. FIG. 8D illustrates pulse width modulation (PWM) encoding in which the light signal shown in FIG. 8D consists of a series of pulses where the width of the pulses is proportional to the corrosion current, $I_{corr}$. FIG. 8E illustrates digital encoding, in which the light signal shown in FIG. 8E consists of a series of digital words. The value encoded in the digital word is proportional to the corrosion current, $I_{corr}$. For example, a four bit word 0000 can be equal to a corrosion current of 0 mA, while the four bit word 1111 can be equal to a corrosion current of 16 mA.

Example #1

Figure 9:
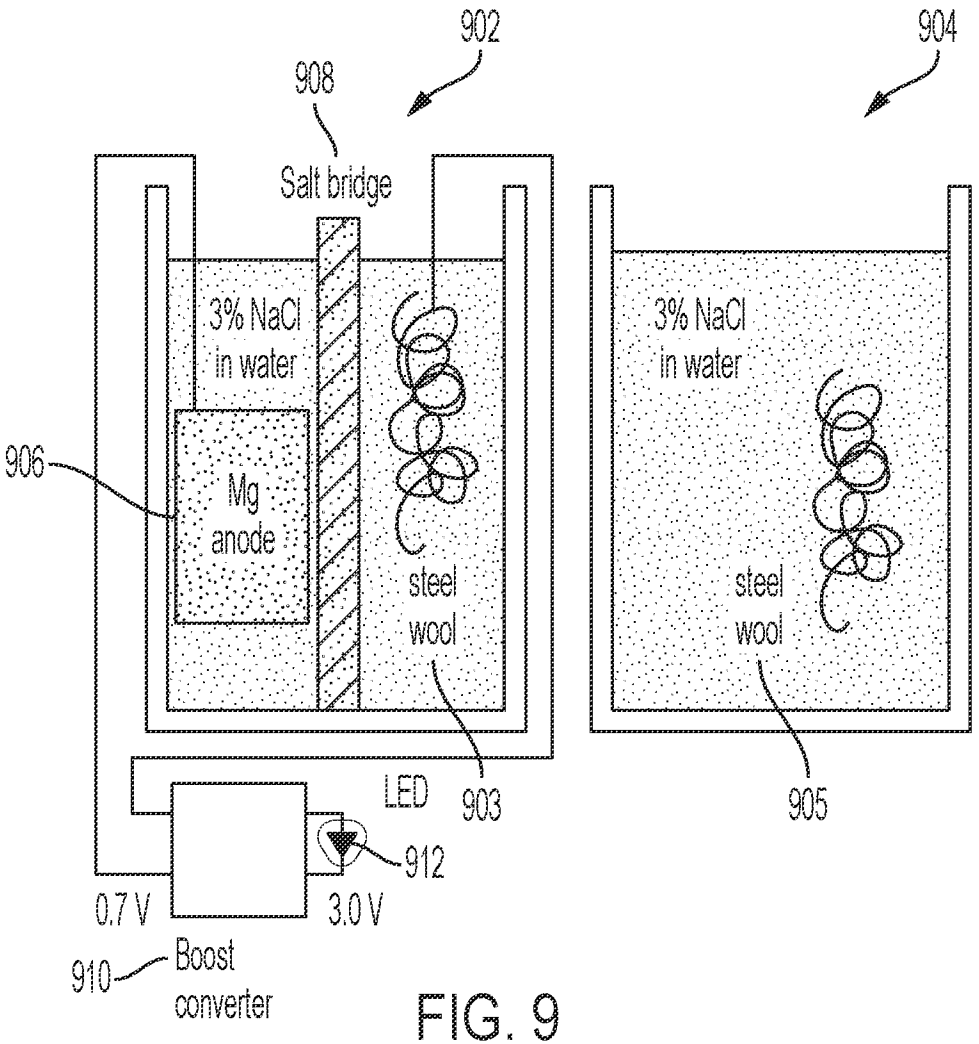
FIG. 9 shows an experimental demonstration of a sacrificial anode-based CP system in accordance with some embodiments, the CP system comprising an electrical-to-optical transducer.

FIG. 9 shows an experimental demonstration of a sacrificial anode-based PC system monitor. Two beakers 902, 904 containing a sample of steel wool 903, 905 were prepared (cathode area ~1 m2). In one beaker 902, the steel wool 903 was wired to a sacrificial anode 906 (Mg alloy) through a DC-DC boost converter 910 and separated by a salt bridge 908 to isolate any Mg reaction products from steel reaction products. At time t=0, a 3% NaCl solution (comparable to seawater) was poured into both beakers 902, 904, and the LED 912 turned on. After 24 hours the LED 912 was still on, and the unprotected steel 905 was noticeably corroded, while the protected steel 903 was not corroded.

The conclusion is that the Mg sacrificial anode 906 both protected the steel wool 903 and drove the LED 912 to emit light, providing a positive indication that the steel wool 903 was protected (or alternatively, that the beaker was full of electrolyte, completing the circuit). This was a somewhat unrealistic demonstration because Mg (high driving voltage) in seawater (high conductivity) with a short path length (low resistance) provides a very large current and also overprotects the steel wool 903. An actual monitor system would use a sacrificial anode that is more appropriate for that environment (e.g., Mg in high resistivity soil, Zn in seawater), which would generate a smaller current, hence the usefulness of power management or external power, which could be supplied over the same fiber as the read out signal (e.g., via a Power-Over-Fiber arrangement).

Example #2

As an example use case, in a sacrificial anode system both steel and anode are buried and difficult to access, making inspection difficult or impossible. In this case, a laser diode and single mode fiber can be installed on the electrical path connecting the anode to steel at the time of anode installation. Coupling the laser diode to a single mode optical fiber allows the fiber to be deployed above ground at the time of anode installation and connected to a test station that could be many kilometers away. During its normal life, the anode supplies electrons which cause the laser diode to emit. When the sacrificial anode is consumed, the flow of current stops, and the laser diode stops emitting, indicating that the anode must be replaced. Both types of cathodic protection systems (sacrificial anode and impressed current) are frequently deployed in arrays of many anodes, and 1550 nm laser diodes can be readily multiplexed via single mode fibers and wavelength-division multiplexing to effectively cover a whole structure, enabling one to pinpoint which sections are corroding most rapidly. This allows better use of the limited time available for inspection.

Example #3

One common application for sacrificial anodes is in water heaters. The high temperature inside a water heater presents a corrosive environment, so a sacrificial anode is usually installed to prevent the water heater tank from corroding and eventually rupturing. A sacrificial CP system of the present disclosure can be implemented in water heaters.

Example #4

Besides detecting the status of the anode, another way to implement various embodiments of the disclosure is to detect changes in the electrolyte. For example, some transformers are buried in underground vaults and protected from corrosion via one or more sacrificial anodes. In this configuration, the electrolyte completing the CP circuit is air or dry soil, which has a low conductivity and therefore a low rate of corrosion. If an extreme weather event such as a hurricane fills the vault with seawater, the electrolyte conductivity increases, more current flows through the circuit, and the light source turns on. This could be detected via an indicator light at the surface that tells a technician that there is seawater in the vault. This detection system would not depend on external power, which may be relevant after an extreme weather event where there is no power. This same methodology can be applied to detect saltwater intrusion into wells or aquifers, where a sudden increase in conductivity could trigger an alarm. Currently, saltwater intrusion is measured intermittently using groundwater samples or aerial surveys. Embodiments of the disclosure can provide an effective approach to continuously monitor for saltwater intrusion.

Although reference is made herein to the accompanying set of drawings that form part of this disclosure, one of at least ordinary skill in the art will appreciate that various adaptations and modifications of the embodiments described herein are within, or do not depart from, the scope of this disclosure. For example, aspects of the embodiments described herein may be combined in a variety of ways with each other. Therefore, it is to be understood that, within the scope of the appended claims, the claimed invention may be practiced other than as explicitly described herein.

All references and publications cited herein are expressly incorporated herein by reference in their entirety into this disclosure, except to the extent they may directly contradict this disclosure. Unless otherwise indicated, all numbers expressing feature sizes, amounts, and physical properties used in the specification and claims may be understood as being modified either by the term "exactly" or "about." Accordingly, unless indicated to the contrary, the numerical parameters set forth in the foregoing specification and attached claims are approximations that can vary depending upon the desired properties sought to be obtained by those skilled in the art utilizing the teachings disclosed herein or, for example, within typical ranges of experimental error.

The recitation of numerical ranges by endpoints includes all numbers subsumed within that range (e.g. 1 to 5 includes 1, 1.5, 2, 2.75, 3, 3.80, 4, and 5) and any range within that range. Herein, the terms "up to" or "no greater than" a number (e.g., up to 50) includes the number (e.g., 50), and the term "no less than" a number (e.g., no less than 5) includes the number (e.g., 5).

The terms "coupled" or "connected" refer to elements being attached to each other either directly (in direct contact with each other) or indirectly (having one or more elements between and attaching the two elements). Either term may be modified by "operatively" and "operably," which may be used interchangeably, to describe that the coupling or connection is configured to allow the components to interact to carry out at least some functionality (for example, a radio chip may be operably coupled to an antenna element to provide a radio frequency electric signal for wireless communication).

Terms related to orientation, such as "top," "bottom," "side," and "end," are used to describe relative positions of components and are not meant to limit the orientation of the embodiments contemplated. For example, an embodiment described as having a "top" and "bottom" also encompasses embodiments thereof rotated in various directions unless the content clearly dictates otherwise.

Reference to "one embodiment," "an embodiment," "certain embodiments," or "some embodiments," etc., means that a particular feature, configuration, composition, or characteristic described in connection with the embodiment is included in at least one embodiment of the disclosure. Thus, the appearances of such phrases in various places throughout are not necessarily referring to the same embodiment of the disclosure. Furthermore, the particular features, configurations, compositions, or characteristics may be combined in any suitable manner in one or more embodiments.

The words "preferred" and "preferably" refer to embodiments of the disclosure that may afford certain benefits, under certain circumstances. However, other embodiments may also be preferred, under the same or other circumstances. Furthermore, the recitation of one or more preferred embodiments does not imply that other embodiments are not useful and is not intended to exclude other embodiments from the scope of the disclosure.

As used in this specification and the appended claims, the singular forms "a," "an," and "the" encompass embodiments having plural referents, unless the content clearly dictates otherwise. As used in this specification and the appended claims, the term "or" is generally employed in its sense including "and/or" unless the content clearly dictates otherwise.

As used herein, "have," "having," "include," "including," "comprise," "comprising" or the like are used in their open-ended sense, and generally mean "including, but not limited to." It will be understood that "consisting essentially of" "consisting of," and the like are subsumed in "comprising," and the like. The term "and/or" means one or all of the listed elements or a combination of at least two of the listed elements.

The phrases "at least one of," "comprises at least one of," and "one or more of" followed by a list refers to any one of the items in the list and any combination of two or more items in the list.

What is claimed is:

1. A system, comprising:

a cathodic protection system comprising an anode and configured to protect a protected structure from corrosion;

a monitoring circuit operatively coupled to the cathodic protection system, the monitoring circuit comprising an electrical-to-optical transducer; and the electrical-to-optical transducer configured to generate a light signal in response to electrical current flowing between the protected structure and the anode of the cathodic protection system, or in response to electrical current flowing between the protected structure and a reference electrode, or in response to electrical current flowing between the reference electrode and the anode;

wherein the monitoring circuit further comprises a coupling circuit comprising a voltage converter, the voltage converter configured to:

step up a voltage generated responsive to the electrical current; and drive the electrical-to-optical transducer with the stepped up voltage.

2. The system of claim 1, wherein the anode is a sacrificial anode configured to supply electrons for the electrical current.

3. The system of claim 1, wherein the anode is an inert anode and the cathodic protection system comprises a power supply that supplies electrons for the electrical current.

4. The system of claim 1, wherein the electrical-to-optical transducer is in series between the anode and the protected structure.

5. The system of claim 1, further comprising a power subsystem configured to supply power to the system.

6. The system of claim 5, wherein the power subsystem includes an energy harvesting device comprising one or more of:

a photovoltaic cell circuit;

a thermoelectric circuit;

a piezoelectric circuit; and a hysteretic circuit configured to harvest energy from galvanic corrosion.

7. The system of claim 6, wherein the power subsystem includes an energy storage device coupled to receive and store energy from the energy harvesting device, the energy storage device comprising one or both of a battery and a capacitor.

8. The system of claim 5, wherein the power subsystem comprises a power-over-fiber apparatus configured to convert optical energy carried by an optical fiber into electrical energy.

9. The system of claim 1, wherein the electrical-to-optical transducer comprises at least one of a light emitting diode, a laser diode, and a superluminescent device.

10. The system of claim 1, wherein the electrical-to-optical transducer includes or is coupled to an encoder, the encoder configured to encode the light signal according to a predefined encoding scheme.

11. The system of claim 10, wherein the encoding scheme comprises one of amplitude modulation encoding, frequency modulation encoding, pulse width modulation encoding, and digital encoding.

12. The system of claim 1, further comprising data acquisition circuitry optically coupled to the electrical-to-optical transducer via a fiber-optic link, the data acquisition circuitry comprising an analyzer configured to measure presence, absence, and an extent of corrosion at the protected structure using the light signal.

13. The system of claim 1, wherein the electrical-to-optical transducer is configured to generate the light signal in response to a trigger stimulus.

14. The system of claim 1, wherein the electrical-to-optical transducer is configured to generate the light signal in response to a trigger stimulus received from a remote source via a fiber-optic link between the remote source and the electrical-to-optical transducer.

15. A method, comprising:

protecting a protected structure from corrosion using a cathodic protection system comprising an anode;

monitoring for corrosion at the protected structure using a monitoring circuit comprising an electrical-to-optical transducer;

generating, by the electrical-to-optical transducer, a light signal in response to electrical current flowing between the protected structure and the anode, or in response to electrical current flowing between the protected structure and a reference electrode, or in response to electrical current flowing between the reference electrode and the anode;

stepping up a voltage generated responsive to the electrical current using a voltage converter;

driving the electrical-to-optical transducer with the stepped up voltage; and communicating the light signal to a remote data acquisition system via a fiber-optic link.

16. The method of claim 15, wherein the anode is a sacrificial anode.

17. The method of claim 15, wherein the anode is an inert anode.

18. The method of claim 15, comprising generating power for the monitoring circuit using an energy harvesting device.

19. The method of claim 15, comprising generating power for the monitoring circuit using a power-over-fiber apparatus.

20. The method of claim 15, comprising encoding the light signal according to a predefined encoding scheme to produce an encoded light signal.

21. The method of claim 20, comprising measuring, by the remote data acquisition system, presence, absence, and an extent of corrosion at the protected structure using the encoded light signal.

22. The method of claim 15, wherein the light signal is generated in response to a trigger stimulus.

23. The method of claim 15, wherein the electrical-to-optical transducer generates the light signal in response to a trigger stimulus received from a remote source via the fiber-optic link between the remote source and the electrical-to-optical transducer.

24. A system, comprising:

a cathodic protection system comprising an anode and configured to protect a protected structure from corrosion;

a monitoring circuit operatively coupled to the cathodic protection system, the monitoring circuit comprising an electrical-to-optical transducer; and the electrical-to-optical transducer configured to generate a light signal in response to electrical current flowing between the protected structure and the anode of the cathodic protection system, or in response to electrical current flowing between the protected structure and a reference electrode, or in response to electrical current flowing between the reference electrode and the anode;

wherein the electrical-to-optical transducer includes or is coupled to an encoder, the encoder configured to encode the light signal according to a predefined encoding scheme.

25. The system of claim 24, wherein the encoding scheme comprises one of amplitude modulation encoding, frequency modulation encoding, pulse width modulation encoding, and digital encoding.

* * * * *